United States Patent [19]

Hirst

[11] 4,246,311

[45] Jan. 20, 1981

[54] WALL COVERING COMPRISING A WEB HAVING AN IMPREGNATION AND A BACK COATING

[75] Inventor: Samuel P. Hirst, Manhattan, N.Y.

[73] Assignee: Chelsea Industries, Inc., New York, N.Y.

[21] Appl. No.: 6,119

[22] Filed: Jan. 23, 1979

[51] Int. Cl.[3] ..... B05D 1/38; B05D 5/04; B32B 27/02; B32B 27/04

[52] U.S. Cl. ..... 428/195; 427/210; 427/261; 427/379; 427/381; 427/393.3; 427/412; 428/215; 428/220; 428/286; 428/290; 428/337

[58] Field of Search ..... 427/210, 261, 379, 381, 427/390 D, 412, 393.3; 428/195, 215, 220, 286, 290, 337

[56] References Cited

U.S. PATENT DOCUMENTS

| | | | |
|---|---|---|---|
| 388,472 | 8/1888 | Beck | 428/174 |
| 1,026,793 | 5/1912 | Frantz | 156/310 |
| 3,160,548 | 12/1964 | Gillick et al. | 428/282 |
| 3,212,957 | 10/1965 | Linda et al. | 428/336 |
| 3,294,618 | 12/1966 | Busche et al. | 428/195 |
| 3,314,840 | 4/1967 | Lloyd et al. | 156/181 |
| 3,616,146 | 10/1971 | Gabet | 428/286 |
| 3,795,567 | 3/1974 | Hoffman | 428/336 |

*Primary Examiner*—James C. Cannon
*Attorney, Agent, or Firm*—Wolf, Greenfield & Sacks

[57] ABSTRACT

A wall covering composed of a base sheet of non-woven polyester material saturated to give it strength, fire retardancy, and opacity and further provides the material with a density that prevents the coating applied to the back from seaping through the sheet. The base sheet is coated on the back to give it greater opacity and make it fungus and mildew resistant. The back coating may also control the thickness as well as the softness or firmness of the sheet. The front surface of the sheet is then transfer printed with the particular design desired.

21 Claims, 5 Drawing Figures

NON-WOVEN BASE SHEET

IMPREGNATED BASE SHEET

COATED AND IMPREGNATED BASE SHEET

FINISHED WALL COVERING

WALL COVERING COMPRISING A WEB HAVING AN IMPREGNATION AND A BACK COATING

INTRODUCTION

This invention relates to wall coverings which are sometimes generically referred to as wall paper although the product itself is not made of paper. More particularly, this invention relates to a new and improved wall covering and a method of manufacturing it.

There are of course a wide variety of wall coverings available made from diverse materials. The least expensive of the various wall coverings available are made of paper, are machine printed, and sell at a very modest price. These inexpensive papers ordinarily are not washable, are not very strong, and are not very flexible so that they, therefore, are difficult to hang. Moreover, the inexpensive wall papers are not fungus and mildew resistant nor do they contain any fire retardant quality.

A more expensive and somewhat improved product which is widely used is the so-called, cloth-backed, vinyl wall covering. This material, while much less perishable than wall coverings made of paper, still has certain disadvantages. Vinyls are relatively stiff and therefore are difficult to hang, particularly at corners and other interruptions in the wall surface. Prints on the vinyl material lack tone intensity of color and sharpness of character, which are the hallmarks of fine wall coverings.

At the top of the line are the hand printed fabrics which are very expensive. And while they are very expensive, they are also very perishable and are most difficult to hang. Because they are so difficult to hang, many paper hangers will not work with such materials or if they do, they charge premium prices for the work. The high cost of hanging the hand printed wall coverings added to the cost of the wall coverings places them beyond the reach of most people.

In accordance with the present invention the base material of the wall covering is a non-woven polyester sheet. This material is light weight and very inexpensive and yet is very easy to handle. The sheet is impregnated with a viscous liquid primarily composed of an acrylic latex. The impregnating layer is not so thick as to completely envelope the fibers, for the polyester fibers must be exposed in order to enable the material ultimately to be transfer printed in accordance with this invention. The acrylic material strengthens the non-woven web, and with additions to the basic compound provides fire retardancy and a degree of opacity not originally present. After the non-woven web is impregnated with the compound, its back is coated with a material compatible with the latex. The coating on the back of the material is necessarily compatible with the latex which impregnates the sheet. The back coating forms a barrier to prevent the paste later used to apply the wall covering, from seaping through the web. The back coating also may impart resistance to fungus and mildew and further increase the opacity of the sheet. The coating on the back of the sheet also substantially increases the thickness of the sheet thereby effecting either the softness and firmness of the sheet. While it imparts strength to the sheet, it makes it more readily moldable so that it is easier to hang in difficult areas.

The front of the treated non-woven material is transfer printed so as to apply the desired design.

The resulting wall covering is in the medium price range—it is very competitive with the typical cloth-backed vinyl coverings. Because the web so treated absorbs the ink just as some of the most expensive fabrics, the resulting product has excellent color tones which are extremely vivid and sharp.

This invention will be better understood and appreciated from the following detailed description when read in connection with the accompanying drawings.

BRIEF FIGURE DESCRIPTION

DETAILED DESCRIPTION

Figure 1:
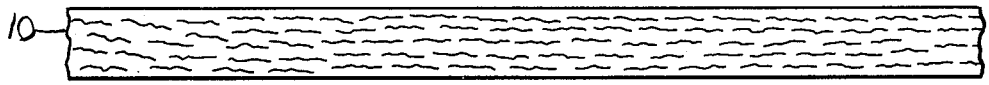
FIG. 1 is a cross sectional view suggesting the non-woven base sheet used in the wall covering of this invention.

In FIGS. 1 to 4 the several stages in the preparation of the wall covering are suggested. In FIG. 1 the base sheet 10 is shown composed of a non-woven material made with polyester fibers. The sheet 10 is very light weight and inexpensive and is a standard item which is presently available through a number of different manufacturing sources. Typically the base sheet 10 may be approximately 0.009 inch in thickness and weigh approximately 1.5 ounces per square yard. The weight and thickness of the sheet material may be increased as the economics of the wall covering market requires, and for example, the sheet may be 0.025 inch thick and weight approximately 4.5 ounces per square yard.

The base sheet 10 shown in FIG. 1 in accordance with the present invention is impregnated with a saturant that principally contains a heat reactive acrylic latex. While the base sheet is impregnated with that material, the impregnation is sufficiently thin so as to leave polyester filaments exposed on the surface so that the base sheet may subsequently be printed upon by the transfer printing technique described below. The impregnated base sheet is suggested in FIG. 2 wherein the saturant 12 is shown to be integrated with the sheet 10.

Figure 2:
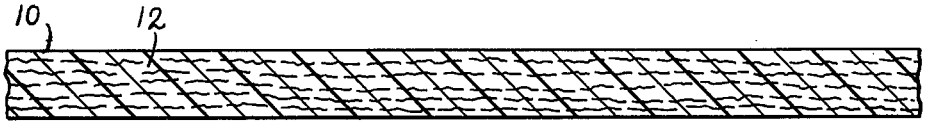
FIG. 2 is a cross sectional view of an intermediate stage in the treatment of the base sheet.
Figure 3:
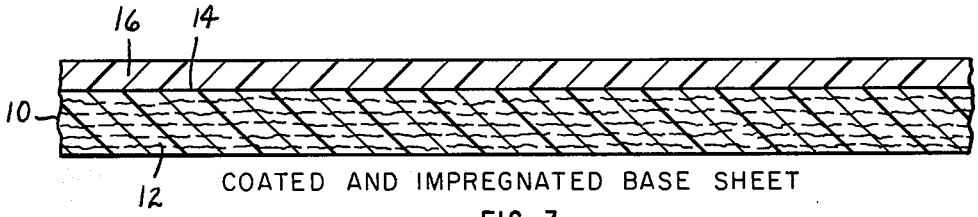
FIG. 3 is a cross sectional view suggesting a second intermediate stage in the preparation of the base sheet in accordance with this invention.

FIG. 3 shows the impregnated sheet of FIG. 2 coated on its rear surface 14 with a material compatible with the saturant 12. The coating 16 is essentially composed of a heat reative acrylic latex and calcium carbonate or other type of filler. Typically the base sheet with the saturant has a thickness of approximately 0.0105 to 0.011 inch, and the thickness of the impregnated and coated base sheet is approximately 0.013 to 0.014 inch. These dimensions may of course vary widely depending upon the particular wall covering.

Figure 4:
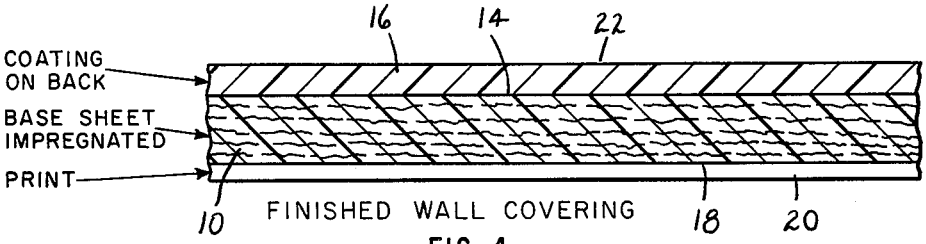
FIG. 4 is a cross sectional view suggesting the composition of the finished wall covering of the present invention.

In FIG. 4, the front surface 18 of the base sheet 10 is shown to carry a layer 20 that represents the printing transferred to the base sheet. Thus, in FIG. 4 the finished product is shown ready for the application of adhesive to the rear surface 22 of coating 16 so as to apply the wall covering to the wall to be decorated.

The non-woven web 10 which comprises the base sheet and in the suggested thickness of approximately 0.009 inch is translucent, rather fragile (easily torn) and has none of the qualities such as fire retardancy, and mildew and fungus resistance that are found in fine quality wall coverings. Rather, the sheet is paper-like and may well contain imperfections. Consequently the base sheet 10 is impregnated with the compound to give it strength, fire retardancy, and a degree of opacity which makes it possible to produce the web in any color desired by introducing to the saturant any selected color pigment. This impregnating step also serves to block the coating compound which is subsequently applied to the back of the sheet and prevents it from seaping through from the back to the face of the material, which could cause problems when the web is subsequently printed. The formulas for the saturant and coating compound are selected so as to be compatible with one another and thereby create a bond between the two and prevent parting or separation of the coating from the web. A typical saturant compound weighing a total of 77 pounds may contain 20 pounds of heat reactive acrylic latex, 38 pounds of water, 12 pounds of antimony oxide, 2 pounds of titanium dioxide, and ½ pound of plasticized fungicide. The proportions by weight of these materials may be varied. For example, the heat reactive acrylic latex may be varied plus or minus 10%, and the fungicide may be reduced or eliminated altogether. The other materials may be altered a few percent without disturbing the saturant.

The coating 16 applied to the back of web 10 has a high degree of white as well as filler. Of course the coating may be tinted so as to lend a different color to the material, and its thickness will effect the softness or firmness of the web as well as the weight. The coating is applied without effecting the face or front surface of the web so that the front surface maintains its nap or fabric feel, and the coating does not interfere with the transfer printing process. The back coating 16 produces a coarse feel which is somewhat bumpy particularly after curing. This characteristic of the coating permits easy windup and release when rolling and unrolling the material prior to heat transfer printing. The coating acts as a barrier to prevent the adhesive from striking through the web.

Typically, the coating 16 may be composed of 50 pounds of heat reactive acrylic latex, 3 pounds of plasticized fungicide, 78 pounds of water, 152 pounds of calcium carbonate, 54 pounds of titanium dioxide, and 6.4 pounds of a thickening agent in a total weight of 343.4 pounds. The calcium carbonate, titanium dioxide and thickening agent may all be radically modified depending upon the color and slurry desired. Furthermore, the content of water may be changed to change the viscosity.

Figure 5:
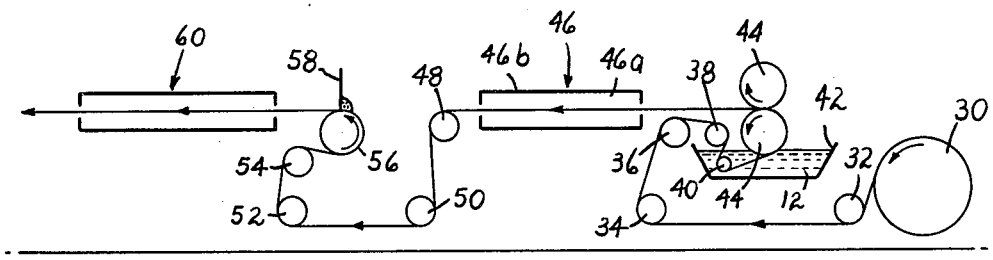
FIG. 5 is a diagramatic view suggesting a preferred method of and apparatus for manufacturing the base sheet of the present invention.

In FIG. 5, the apparatus for manufacturing the web and applying the saturant and coating is shown. The non-woven web material 10 is shown arranged in a roll 30 and trained about guide rollers 32, 34, 36, 38 and 40 into trough 42 which contains the saturant 12 in a highly viscous but liquid form. After the web passes through the trough 42 and picks up the saturant, it passes between a pair of rubber pressure rollers 44 that together serve as a padder that extracts a specific amount of the saturant and leaves a predetermined amount in the web. The degree to which the saturant is squeezed from the web may be varied by adjusting the pressure applied by the rollers to the web.

After leaving the padder rollers 44, the saturated web is passed through oven 46 which in the preferred form has two zones **46*a* and 46*b*. The temperature in the first zone 46*a* is between 200° F. and 250° F. In the second zone 46*b* the temperature is 250° F. to 300° F. The web may typically be in the oven for approximately 45–60 seconds. The actual time is determined by the quantity of saturant applied, the amount of solids in it, and the temperature in each zone of the oven 46**. The reason for the differential in heat in the two zones is to slowly cure the web without causing a shock to the material or the compound, which could cause air or moisture to be trapped in the web. The drying process should be even and thorough.

After leaving oven 46, the material travels about several guide rollers 48, 50, 52 and 54 and about large roller 56 on which roller the coating compound is applied. The roller 56 is part of the knife coater assembly which includes a blade 58. The surface of roller 56 is made of rubber, and the knife blade 58 is adjustable so that the amount of coating material applied to the surface may be varied. The knife and compound may be adjusted to accommodate the desired thickness as well as the opacity and the "hand" of the material. After leaving the knife coater, the web passes through a second oven 60 in approximately 45–60 seconds where the coating is thoroughly cured at approximately 375° F. The oven time is determined by the same considerations that determined the time in oven 46. Thereafter the coated web may pass through trimming equipment and be rolled in accordance with standard procedures followed in handling fabric and paper.

As indicated above, the pattern of the paper is applied by the transfer printing technique, which is a well-known process. However, the preparation of the web material is for that type of printing and therefore it cooperates with the other procedures of the manufacturing technique as part of the present invention. Thus, the face 18 of the web is provided with a nap, and the coarse back coat is compressed during the transfer printing, which allows the transfer printing equipment to register the pattern with ample pressure. That is, the back coating 16 is sufficiently compressible so as to allow the web to be compressed without disturbing the finish of the front face of the fabric.

In the transfer printing process, the pattern is applied to a substrate of paper or other material by gravure or screen printing. The printed face of the substrate is placed face to face with the surface of the web to be printed, and the two are passed between a belt and the cylindrical surface of a drum about which the belt travels. The drum is heated to a predetermined temperature, and the heat causes the ink on the substrate to sublimate and transfer to the web surface. The substrate is then discarded. The transfer printing process is conducted under temperatures in excess of 375° F. and under pressure, and for a period of 15 seconds or more, and as a result, chemical crosslinking occurs between the coating and the impregnating compound so that it becomes inert to give the material a permanent chemical finish.

It will be appreciated that the wall covering constructed in accordance with this invention has the feel of a fabric or suede and yet is completely washable. The printing on the web can achieve an intensity of color and sharpness of character not possible with the vinyl and fabric wall coverings now available. The wall covering is much easier to handle than the standard cloth-backed vinyl since it has greater flexibility to conform to irregular wall surfaces. The wall covering of the present invention is stronger and more flexible than paper wall covering, and will not deteriorate. Furthermore, it is fungus and mildew resistant as well as fire retardant. Perhaps the greatest advantage is the very fine printing surface provided.

What is claimed is:

1. A wall covering sheet comprising a base layer of thin non-woven polyester material impregnated with a saturant to provide strength, fire retardancy and fungus and mildew resistance to the sheet but having a fabric feel to at least the front surface thereof, a coating applied to the back of the sheet to provide opacity to the sheet and prevent adhesive applied to the back of the sheet from striking through it, and a pattern printed on the front of the sheet.

2. A wall covering sheet as defined in claim 1 further characterized by said impregnated base layer being approximately 0.011 inches thick and said coated sheet being approximately 0.013 inches thick.

3. A wall covering sheet as defined in claim 1 further characterized by the impregnated base layer and the coating being the same color.

4. A wall covering sheet as defined in claim 1 wherein said saturant and coating are both of a compatible material including a heat reactive acrylic latex.

5. A wall covering sheet as defined in claim 4 wherein said saturant also comprises antimony oxide and titanium dioxide.

6. A wall covering sheet as defined in claim 4 wherein said coating also comprises calcium carbonate and titanium dioxide.

7. A wall covering sheet as defined in claim 6 wherein the major coating component weightwise is calcium carbonate.

8. A method of making wall covering material comprising the steps of providing a continuous web of non-woven material, impregnating the non-woven web with a viscous liquid to increase its strength, fire retardancy and opacity, curing the impregnated web by passing it through a heating oven, next applying a viscous coating material to the back of the continuous non-woven web, which coating is compatible with and bonds to the impregnating material to further increase the opacity and thickness of the web and provide a screen to prevent adhesive applied to the back from striking through the non-woven web, and drying the coating material by passing the web through a second heating oven.

9. A method as defined in claim 8 further characterized by transfer printing the upper surface of the non-woven web with the desired pattern.

10. A method as defined in claim 8 further characterized by said continuous web being a polyester and said impregnating and coating materials being of the same color.

11. A method as defined in claim 8 further characterized by said impregnating material including a heat reactive acrylic latex and leaving the filaments of the non-woven web sufficiently exposed to absorb transfer printing inks.

12. A method of making a wall covering material comprising the steps of providing a thin web of material and impregnating the web with a saturant to increase its thickness, curing the impregnated web and thereafter applying a coating to the back of the web to form a barrier for adhesive to be applied to the back and to further increase the web thickness, and drying the coating.

13. A method as defined in claim 12 further characterized by said web being a non-woven polyester material, and limiting the thickness of the impregnating material so that the front of the sheet has a fabric-like feel.

14. A method as defined in claim 13 further characterized by said web being in the order of approximately 0.009 inch in thickness, said saturant increasing the web thickness to approximately 0.011 inch, and said coating further increasing the web thickness to approximately 0.013 inch.

15. A method as defined in claim 8 wherein the impregnating is controlled to provide a predetermined amount of saturant in the web.

16. A method as defined in claim 8 wherein the step of curing occurs in two heat zones including curing at a temperature in the range of 200° F. to 250° F. followed by curing in the range of 250° F. to 300° F.

17. A method as defined in claim 8 wherein the step of curing occurs in two heat zones including curing at a first temperature followed by curing at a higher temperature.

18. A method as defined in claim 17 wherein the web is in the first oven for 45–60 seconds.

19. A method as defined in claim 16 wherein the drying occurs at a temperature on the order of 375° F.

20. A method as defined in claim 17 wherein the drying occurs at a temperature still greater than said higher curing temperature.

21. A method as defined in claim 19 further characterized by said coating material including a heat reactive acrylic latex.

* * * * *